US008418262B2

(12) United States Patent
Angus

(10) Patent No.: US 8,418,262 B2
(45) Date of Patent: Apr. 16, 2013

(54) BODY ARMOUR PROTECTION SYSTEM PROTECTIVE HOCKEY UNDERSHIRT

(76) Inventor: Ross M. Angus, Nepean (CA)

( * ) Notice: Subject to any disclaimer, the term of this patent is extended or adjusted under 35 U.S.C. 154(b) by 1287 days.

(21) Appl. No.: 10/351,218

(22) Filed: Jan. 27, 2003

(65) Prior Publication Data

US 2006/0162043 A1 Jul. 27, 2006

(51) Int. Cl.
*A41D 13/00* (2006.01)

(52) U.S. Cl.
USPC ..... 2/2.5

(58) Field of Classification Search ..... 2/2.5, 102, 2/94, 96, 97, 464, 467; 89/36.01, 36.02, 89/36.05; 428/911
See application file for complete search history.

(56) References Cited

U.S. PATENT DOCUMENTS

| | | | | |
|---|---|---|---|---|
| 2,238,466 | A * | 4/1941 | Gardner | 2/54 |
| 2,715,226 | A | 8/1955 | Weiner | |
| 3,281,863 | A * | 11/1966 | Beard et al. | 2/113 |
| 4,195,362 | A * | 4/1980 | Rolando | 2/461 |
| 4,738,893 | A | 4/1988 | Grillo | |
| 4,802,242 | A * | 2/1989 | Lars-Jos | 2/2.5 |
| 4,864,656 | A * | 9/1989 | Nesse | 2/97 |
| 4,989,266 | A | 2/1991 | Borgese et al. | |
| 5,044,011 | A * | 9/1991 | Henderson | 2/2.5 |
| 5,335,372 | A * | 8/1994 | Wiedner et al. | 2/457 |
| 5,388,271 | A * | 2/1995 | Sessoms | 2/115 |
| 5,734,992 | A | 4/1998 | Ross | |
| 5,790,982 | A * | 8/1998 | Boutboul et al. | 2/53 |
| 5,845,336 | A * | 12/1998 | Golde | 2/93 |
| 6,038,701 | A | 3/2000 | Regan | |
| 6,044,498 | A | 4/2000 | Schumann et al. | |
| 6,141,800 | A | 11/2000 | Regan | |
| 6,155,084 | A | 12/2000 | Andrews et al. | |
| 6,260,196 | B1 * | 7/2001 | van der Sleesen | 2/2.5 |
| 6,591,425 | B1 * | 7/2003 | Zellers | 2/54 |
| 6,748,601 | B2 * | 6/2004 | LaShoto et al. | 2/102 |
| 7,076,806 | B1 * | 7/2006 | Van Winkle et al. | 2/2.5 |
| 7,426,753 | B1 * | 9/2008 | Rivers et al. | 2/2.5 |

FOREIGN PATENT DOCUMENTS

| | | |
|---|---|---|
| CA | 1229511 | 11/1987 |
| EP | 0 765 612 | 4/1997 |
| WO | WO 00/08410 | 2/2000 |

* cited by examiner

*Primary Examiner* — Tejash Patel
(74) *Attorney, Agent, or Firm* — Dowell & Dowell, PC

(57) ABSTRACT

A hockey shirt with a lower trunk opening, a neck opening and collar, including sleeves and cuff assembly. The shirt has special protective cover stitched, surged or fused on the lower sleeves, underarm parts and armpits to prevent against gashes, cuts and other injuries caused by skate blades.

15 Claims, 1 Drawing Sheet

BODY ARMOUR PROTECTION SYSTEM PROTECTIVE HOCKEY UNDERSHIRT

FIELD OF THE INVENTION

This invention relates generally to the field of sports equipment, and more particularly to hockey equipment of the sort worn by a player to provide comfort and protection during the rough and tumble play of the game of hockey.

BACKGROUND OF THE INVENTION

Ice hockey is one of the most popular team sports played in Canada and the USA. It is a fast-paced game that combines players of many sizes together on the rink with high skating speed and fast, furious action.

Hockey is known as a hard-hitting, collision sport. Players risk injury from high-impact collisions with each other, the rigid boards that mark the boundary of the playing surface, and the goal posts. Impact with a skate blade, long sticks, and pucks traveling more than 100 MPH also add to the risk.

Lacerations (cuts) to the head, scalp and face have been reduced by the use of helmets and face shields but sadly, more serious cuts still continue to cause physical trauma to players at all levels in minor and major league hockey, including ringette, recreational and pick-up hockey games and practices.

While newer protective equipment is lighter, stronger and offers more protection, it has also been modified to make hockey movement easier. In particular, hockey gloves are now shorter and expose players to more wrist and arms injuries than before. Likewise, there is no equipment to protect the underarms, sides of torso and armpits from serious cuts.

What is required is not only protection for the body parts susceptible to injury from skate blades, but protection that is lightweight, inexpensive and doesn't impede range of motion, particularly wrist and shoulder movement.

SUMMARY OF THE INVENTION

According to one aspect of the present invention, there is provided a protective undergarment worn for ice skating sports comprising a torso portion having a front, a back and a neck opening, said torso portion comprising a jersey fabric, and first and second sleeves which extend from and are joined to or integral with said torso portion, each sleeve including a flexible, high performance fabric, resistant to cutting; wherein at least a part of said front and back of said torso portion between opposed sides thereof comprises said jersey fabric without any flexible high performance fabric resistance to cutting.

According to the present invention, there is provided a protective undergarment comprising a torso portion having a front, a back and a neck opening, left and right arm sleeves which extend from and are directly joined to or integral with said torso portion such that the torso portion and said sleeves form a unitary undergarment, wherein, when the protective garment is laid flat, the upper arm portion of each sleeve has a front and a back, and opposed upper and lower edges, wherein each sleeve has a forearm portion comprising a flexible, high performance fabric, resistant to cutting by skate blades and at least part of the torso portion between opposed sides thereof comprises jersey fabric.

Advantageously, this arrangement provides an undergarment for ice hockey and other ice skating sports which provides arm protection from skate blade lacerations while providing comfort to the wearer by reducing chaffing, itching and other discomforts that might arise if the entire undergarment were made from high performance material only. Furthermore, the invention provides a product which does not add to the list of clothing or equipment worn today by players, but replaces an existing item of apparel.

Also according to the present invention, there is provided a protective undergarment comprising a torso portion having a neck opening, first and second arm sleeves extending from said torso portion and including an upper arm portion for covering the upper arms of a wearer, each upper arm portion having an underside portion, and wherein each underside portion includes a high performance, flexible fabric, resistant to cutting.

According to the present invention, there is further provided a protective undergarment worn for ice skating sports comprising a torso portion having a front, a back and sides between the front and back, and a neck opening, first and second arm sleeves extending from said torso portion and a high performance flexible fabric, resistant to cutting by skate blades, extending from an underside of each sleeve to a respective side to provide underarm protection.

According to the present invention, there is further provided a protective undergarment comprising a torso portion having a neck opening, first and second arm sleeves extending from said torso portion, each sleeve including a lower arm portion for covering a lower arm of a wearer and wherein said lower arm portion comprises a high performance, flexible fabric resistant to cutting.

According to the present invention, there is further provided a protective undergarment comprising a torso portion having a front, a back and a neck opening, said torso portion comprising a jersey fabric, and a flexible, high performance fabric, resistant to cutting and forming first and second sleeves which are joined to said torso portion.

According to the present invention, there is further provided a protective undergarment comprising a torso portion having a neck opening, first and second arm sleeves extending from said torso portion, each sleeve being formed of a jersey fabric and a high performance, flexible fabric, resistant to cutting by skate blades and joined to said jersey fabric to thereby form an integral sleeve therewith.

Embodiments of the invention provide a simple and easy method for protecting arm and torso parts not covered by existing hockey equipment protection.

Embodiments of the invention provide a product that is easily maintained and laundered as it will be worn often and close to the skin.

Embodiments of the invention provide a product that improves the comfort of the wearer, such as by reducing chaffing, itching and other discomforts that might arise if the entire shirt were to be fabricated with the protective covering only.

Embodiments of the invention provide a product that does not inhibit range of motion, thereby maintaining a player's effectiveness.

Embodiments of the invention provide a product that can be mass produced.

Embodiments of the invention provide a product that is affordable.

Embodiments of the invention provide a product that can accommodate players of all sizes.

In one embodiment, the undergarment comprises an undershirt for use by hockey players, the undershirt comprising: a torso portion with a lower trunk opening; a pair of sleeves attached to the torso portion with protective covering on the forearms, underarms and armpit areas; a sleeve cuff assembly on each of said sleeves; and a head opening.

In one embodiment, the protective covering is made of an aramid fiber to guard against cuts and gashes between the hockey gloves and the elbow pads and shoulder pads; on the underside of the arms, in the armpit and on the sides of the torso.

In some embodiments, the protective covering is sewn, surged (interlock) or fused between a layer of garment fabric made of 50% polyester and 50% cotton (or tubular 100% cotton and other similar materials without affecting the integrity of the safety features) and a layer of rip-stock nylon on top. In some embodiments, the protective covering is 100% aramid fiber material. It is five times stronger than an equal weight of steel, has exceptional stretch resistance and is inherently flame resistant. This fibre is used extensively in Personal Body Armour, specialized gear for Correctional Officers and has many other uses in workplace safety. As well as providing protection against lacerations, it is light in weight, provides an extended-wear life and can be laundered.

BRIEF DESCRIPTION OF THE DRAWINGS

Examples of embodiments of the present invention will now be described with reference to the drawings, in which.

DETAILED DESCRIPTION OF EMBODIMENTS

Figure 1A:
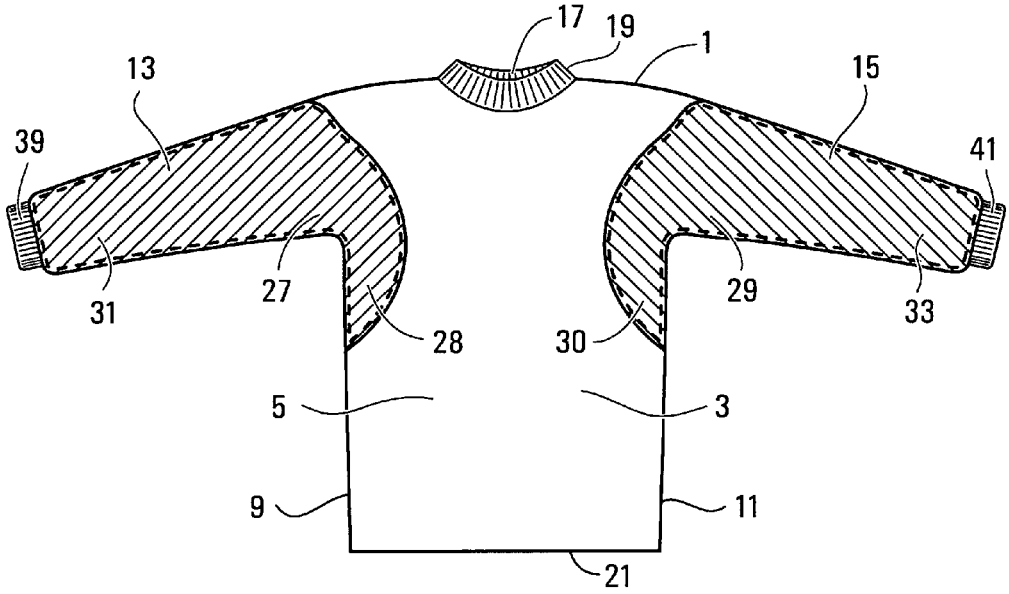
FIG. 1A shows a front view of an undershirt according to an embodiment of the present invention.
Figure 1B:
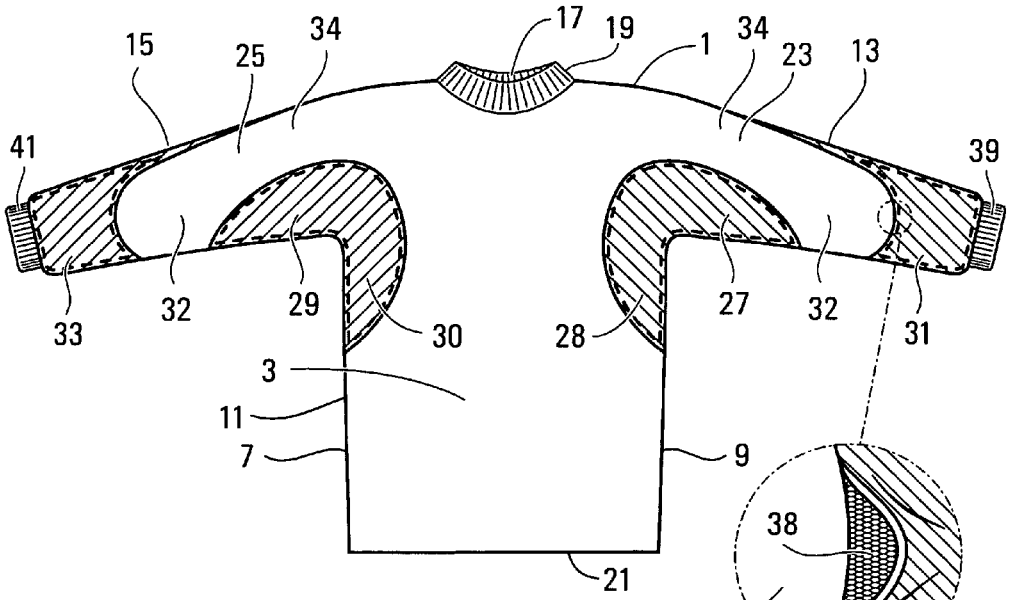
FIG. 1B shows a back view of the undershirt shown in FIG. 1A.

Referring to FIGS. 1A and 1B, an undershirt 1 according to an embodiment of the present invention comprises a torso portion 3, having a front 5, a back 7, and two side portions 9, 11, and right and left arm sleeves 13, extending from the torso portion 3. The torso portion further includes a neck opening 17, which may include a cuff 19, and a lower trunk opening 21.

The torso portion comprises a fabric, for example a combination of 50% polyester and 50% cotton. In other embodiments, the torso portion may be made of tubular 100% cotton or other similar materials without affecting the integrity of the safety features.

The sleeves 13, 15 each comprises a first layer of fabric 23, 25 which may comprise for example a combination of 50% polyester and 50% cotton, tubular 100% cotton or other similar materials. The sleeves 13, 15 further include a second layer of material, shown by broken lines, comprising a high performance, flexible fabric, which is resistant to cutting by skate blades and which overlays the first layer of fabric 13, 15 in the regions of an underside portion 27, 29 of the upper arm of the sleeve, the lower arm portion 31, 33 and a portion 28, 30 of the undergarment which extends from the upper arm to the side portions 9, 11 of the torso portion 3.

Figure 1C:
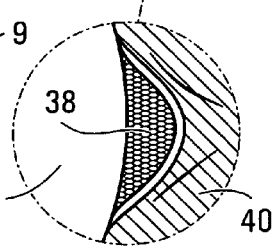
FIG. 1C shows an enlarged view of a portion of the undershirt showing an assembly of garment material and aramid fibre material, used in embodiments of the invention.

In the particular embodiment shown in FIGS. 1A and 1B, the second layer, which may comprise 100% Kevlar, covers the lower arms, both front and back, the upper underarms, the armpits and the sides of the torso down to where the ribcage ends. However, in this embodiment, the protective layer does not cover a portion of the back of the upper arm of the sleeve proximate in the elbow region 32 and the upper edge 34. Regions of the sleeves which include high performance flexible cut resistant fabric are shown in the figures by hatching. In this embodiment a layer of rip-stock nylon covers the protective layer and regions of rip-stock nylon are also shown by the hatching. The protective layer may be joined to the jersey fabric by for example stitching, as shown in FIG. 1C. FIG. 1C shows an enlarged view of a stitch in which reference numeral 36 indicates jersey fabric, for example 50% polyester and 50% cotton, 38 indicates high performance, flexible cut resistant fabric, and 40 indicates rip-stock nylon.

The undershirt may be manufactured in standard Canadian sizes for children and adults or could be custom made.

In this embodiment, the sleeves include a wrist cuff assembly 37, 39 comprising a rib fabric (eg. a knitted rib fabric) to ensure a secure and comfortable fit for all wrist sizes. Likewise, the neck opening or cuff 19 may comprise a rib fabric (eg. a knitted rib fabric) designed to fit various neck sizes and to be comfortable.

Thus, in embodiments of the protective undergarment, a mixture of 50% polyester and 50% cotton, or other similar material is used for the non-protective parts of the garment. Rib knit or similar material may be used for the collar and cuffs. An aramid fibre material is used for protection in the underarms, cuffs and armpit areas. This material is sewn, surged (interlock), or fused between layers of the polycotton or other similar material and rip-stock nylon cover layer.

A particularly advantageous feature of embodiments of the present invention is the combination of an undershirt with a protective covering.

It can now be appreciated that the most preferred form of an embodiment of the present invention is to combine protection and undershirt into one product, providing essentially built-in protection. Instead of providing a 100% Kevlar undershirt protection as well as a regular hockey undershirt, two dressing room steps are reduced to a single one. All that is needed is to pull the undershirt on over the head and arms. When removing the undershirt it is just as easy. Further, the whole undershirt can be easily put into the wash, meaning that the sweat accumulated is eliminated. In this way this equipment can be kept clean and fragrant.

Various modifications and alterations are possible to the form of the invention, without departing from the scope of the broad claims as attached hereto. In particular, while reference has been made to a particular jersey material or rib fabric, it is possible to alter those fabrics without compromising the protective nature of the undershirt or its value to hockey players.

The invention claimed is:

1. A protective undergarment comprising a torso portion having a front, a back and a neck opening, left and right arm sleeves which extend from and are directly joined to or integral with the torso portion such that the torso portion and the sleeves form a unitary undergarment, wherein, when the protective garment is laid flat, the upper arm portion of each sleeve has a front and a back, and opposed upper and lower edges, wherein each sleeve has a wrist and forearm section having a portion that includes a plurality of fabric layers at least one of which is a flexible, high performance protective fabric which is resistant to cutting by skate blades, and wherein at least part of the front and back of the torso portion between opposed sides thereof is constructed of non-protective jersey fabric material.

2. A protective undergarment as claimed in claim 1, wherein at least one of the plurality of fabric layers of each of said left and right sleeves is a jersey fabric having the high performance protective fabric joined thereto.

3. protective undergarment as claimed in claim 2, wherein the portion of the wrist and forearm section having the flexible high performance protective fabric layer extends along a portion of each sleeve from a wrist area to a shoulder and under arm area.

4. A protective undergarment as claimed in claim 1, wherein the upper arm portion of each sleeve has an upper portion adjacent said upper edge, wherein a region of the upper side is constructed of jersey fabric without any high performance protective fabric.

5. A protective undergarment as claimed in claim 1, wherein a region of the back of the upper arm portion proximate the upper edge is constructed of jersey fabric without any high performance protective fabric.

6. protective undergarment as claimed in claim 1, wherein the jersey fabric is formed of a material selected of a group of materials consisting of cotton, and a mixture of cotton and synthetic fibre.

7. A protective undergarment as claimed in claim 1, wherein said high performance protective fabric is an aramid fabric.

8. A protective undergarment as claimed in claim 3, wherein each sleeve includes a rear elbow region formed of a jersey fabric without any high performance protective fabric material.

9. The use of a protective undergarment as claimed in claim 1 for protection against injury from skate blades.

10. A protective undergarment as claimed in claim 1, wherein each sleeve further includes a wrist cuff assembly for securely fitting about a wearer's wrist.

11. A protective undergarment as claimed in claim 1, formed as a protective undershirt having a lower peripheral edge, and wherein a major part of the front and back of the torso portion between the opposed sides of the torso portion and between the neck opening and the lower edge are without any flexible high performance protective fabric, resistant to cutting.

12. A protective undergarment as claimed in claim 1, wherein the left and right sleeves each include jersey fabric, and the flexible, high performance protective fabric overlays said jersey fabric.

13. A protective undergarment as claimed in claim 1, wherein the portion of the wrist and forearm section surrounds the wrist of a wearer.

14. A protective undergarment as claimed in claim 1, wherein the flexible, high performance protective fabric material extends from the forearm and wrist section to an upper arm section of the sleeves to underarm portions and along an upper portion of sides of the torso portion.

15. A protective undergarment as claimed in claim 1, wherein each sleeve has an underside region extending along the front and back, adjacent the lower edge, the front and back of said torso portion each having left and right side regions including a flexible, high performance Protective fabric, resistant to cutting by skate blades, the high performance protective fabric extending from a position below the junction between the torso portion and a respective sleeve upwardly along the left and right side regions to and along the underside region of the upper arm portion of each sleeve, and wherein the left and right side regions of the torso portion have respective edges which are spaced apart by a middle region of the torso portion, wherein the middle region is formed of jersey fabric.

* * * * *